US011346058B2

(12) United States Patent
Pleyber et al.

(10) Patent No.: US 11,346,058 B2
(45) Date of Patent: May 31, 2022

(54) MULTI-PLY TISSUE PAPER PRODUCT AND METHOD OF MANUFACTURING

(71) Applicant: Essity Hygiene and Health Aktiebolag, Gothenburg (SE)

(72) Inventors: Emilie Pleyber, Kunheim (FR); Sebastien Jeannot, Kunheim (FR); Donald Barredo, Kunheim (FR); Yves Enggasser, Kunheim (FR); Frederic Roesch, Kunheim (FR); Steve Baltase, Holtzwihr (FR)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 197 days.

(21) Appl. No.: 16/491,006

(22) PCT Filed: Mar. 13, 2017

(86) PCT No.: PCT/EP2017/055795
§ 371 (c)(1),
(2) Date: Sep. 4, 2019

(87) PCT Pub. No.: WO2018/166572
PCT Pub. Date: Sep. 20, 2018

(65) Prior Publication Data
US 2020/0011014 A1 Jan. 9, 2020

(51) Int. Cl.
*D21H 27/30* (2006.01)
*D21H 27/00* (2006.01)
(Continued)

(52) U.S. Cl.
CPC ..... *D21H 27/30* (2013.01); *D21H 27/002* (2013.01); *B31F 1/07* (2013.01);
(Continued)

(58) Field of Classification Search
CPC ..... D21H 27/30; D21H 27/002; D21H 27/02; D21H 27/40; B31F 1/07;
(Continued)

(56) References Cited

U.S. PATENT DOCUMENTS 4,284,465 A 8/1981 Walbrun
4,320,162 A 3/1982 Schulz
(Continued)

FOREIGN PATENT DOCUMENTS

CA 2049552 A1 2/1992
CN 104302471 A 1/2015
(Continued)

OTHER PUBLICATIONS

International Searching Authority, Search Report and Written Opinion issued in International Application No. PCT/EP2017/055795 dated Nov. 9, 2017 (14 pages).
(Continued)

*Primary Examiner* — Jose A Fortuna
(74) *Attorney, Agent, or Firm* — Cantor Colburn LLP

(57) ABSTRACT

A multi-ply tissue paper product includes at least four plies made of tissue paper base-sheet or non-woven. Two inner plies are positioned between a first outer ply on one side and a second outer ply on another side. The two inner plies are flat plies. The first and second outer plies include a micro-embossing pattern. Only one of the outer plies further includes a décor embossing pattern. The multi-ply tissue paper product is configured to provide improved thickness and strength parameters with less use of paper fiber material.

18 Claims, 5 Drawing Sheets

(51) Int. Cl.
*B31F 1/07* (2006.01)
*D21H 27/02* (2006.01)

(52) U.S. Cl.
CPC ..... *B31F 2201/0733* (2013.01); *B31F 2201/0738* (2013.01); *B31F 2201/0756* (2013.01); *D21H 27/02* (2013.01)

(58) Field of Classification Search
CPC ..... B31F 2201/0733; B31F 2201/0738; B31F 2201/0756; B31F 2201/0764; B31F 2201/0774; B31F 2201/0782
See application file for complete search history.

(56) References Cited

U.S. PATENT DOCUMENTS

| | | | | |
|---|---|---|---|---|
| 4,376,671 | A | 3/1983 | Schulz | |
| 6,551,691 | B1 | 4/2003 | Hoeft et al. | |
| 6,599,614 | B1 | 7/2003 | Roussel et al. | |
| 6,746,558 | B2 | 6/2004 | Hoeft et al. | |
| 6,805,766 | B1 | 10/2004 | Roussel et al. | |
| 8,708,020 | B2 | 4/2014 | Schutz | |
| 8,974,892 | B2 * | 3/2015 | Nencioni | D21H 27/30 428/172 |
| 9,637,862 | B2 * | 5/2017 | Saas | B31F 1/07 |
| 9,663,900 | B2 * | 5/2017 | Jeannot | B32B 29/005 |
| 10,654,239 | B2 * | 5/2020 | Stefani | B32B 3/30 |
| 2003/0129363 | A1 | 7/2003 | Hoeft et al. | |
| 2004/0028935 | A1 | 2/2004 | Hauke | |
| 2006/0222819 | A1 | 10/2006 | Gambini | |
| 2006/0283538 | A1 | 12/2006 | Schulz et al. | |
| 2007/0092700 | A1 * | 4/2007 | Maddaleni | B31F 1/07 428/174 |
| 2007/0184246 | A1 | 8/2007 | Nencioni et al. | |
| 2009/0162597 | A1 * | 6/2009 | Barredo | D21H 27/40 428/57 |
| 2009/0226670 | A1 | 9/2009 | Schutz | |
| 2009/0297781 | A1 | 12/2009 | Huss et al. | |
| 2011/0123773 | A1 * | 5/2011 | Lofink | B31F 1/07 428/166 |
| 2012/0152445 | A1 * | 6/2012 | Barredo | D21H 27/40 156/219 |
| 2012/0164426 | A1 * | 6/2012 | Barredo | D21H 27/40 428/220 |
| 2012/0255671 | A1 | 10/2012 | Wallstabe et al. | |
| 2015/0184342 | A1 | 7/2015 | Saas et al. | |
| 2015/0225903 | A1 * | 8/2015 | Jeannot | B32B 29/005 162/132 |
| 2020/0011014 | A1 * | 1/2020 | Pleyber | D21H 27/002 |
| 2021/0180260 | A1 * | 6/2021 | Satake Neto | B31F 1/07 |
| 2021/0292972 | A1 * | 9/2021 | LeCount | B31F 1/07 |
| 2021/0310197 | A1 * | 10/2021 | LeCount | D21H 27/40 |
| 2021/0381172 | A1 * | 12/2021 | Goulet | B31F 1/07 |
| 2022/0010498 | A1 * | 1/2022 | Pleyber | D21F 3/08 |

FOREIGN PATENT DOCUMENTS

| | | | | |
|---|---|---|---|---|
| CN | 111727288 | A | 9/2020 | |
| DE | 102005055707 | A1 | 5/2007 | |
| EP | 0264676 | A1 | 4/1988 | |
| EP | 1338412 | A1 | 8/2003 | |
| EP | 2095935 | A1 | 9/2009 | |
| EP | 2353859 | A1 | 8/2011 | |
| EP | 2664451 | A1 | 11/2013 | |
| EP | 2692948 | A1 | 2/2014 | |
| EP | 2754553 | A2 | 7/2014 | |
| EP | 2353859 | B1 * | 3/2017 | B31F 1/07 |
| GB | 9110616 | | 7/1991 | |
| WO | 9711228 | A1 | 3/1997 | |
| WO | 02103112 | A1 | 12/2002 | |
| WO | 03072344 | A1 | 9/2003 | |
| WO | 2005095100 | A1 | 10/2005 | |
| WO | 2010086837 | A2 | 8/2010 | |
| WO | 2010086837 | A3 | 11/2010 | |
| WO | 2011078755 | A1 | 6/2011 | |
| WO | WO-2018166572 | A1 * | 9/2018 | D21H 27/30 |

OTHER PUBLICATIONS

Colombian Patent Office, Office Action issued in CO NC2019/0010000 dated Aug. 9, 2021 with partial English Translation (15 pages).

National Intellectual Property Administration (CNIPA) of the People's Republic of China, Office Action issued in App. No 201780086232.5 dated Nov. 19, 2021 with English Translation (17 pages).

* cited by examiner

MULTI-PLY TISSUE PAPER PRODUCT AND METHOD OF MANUFACTURING

CROSS-REFERENCE TO RELATED APPLICATION

This application is a national stage entry under 35 U.S.C. § 371 of, and claims priority to, International Application No. PCT/EP2017/055795, filed Mar. 13, 2017. The above-mentioned patent application is incorporated herein by reference in its entirety.

TECHNICAL FIELD

This application relates to a multi-ply tissue paper product, such as may be used in the tissue paper industry.

BACKGROUND

Tissue paper may be used for sanitary or domestic purposes. As an example, a web of tissue paper is wound onto a core for the purpose of manufacturing paper towel, toilet tissue rolls, facial rolls, bathroom tissue, wiping tissue or kitchen tissue rolls. As another example, a web of tissue paper is fold for the purpose of manufacturing facial tissue, handkerchiefs, bathroom tissue or napkins.

In the following a tissue paper product relates to an absorbent paper based on cellulose wadding which is also called tissue paper base-sheet in this field of technology. A typical absorbent paper has a low basis weight, in the range from 10 to 60 g/m$^2$, or 30 to 50 g/m$^2$.

The tissue paper can be produced from paper-making fibers according to "Conventional Processes" as in the manufacture of "Dry Crepe Tissue" or "Wet Crepe Tissue" or "Processes for Structured Tissue" such as the Through Air Drying (TAD) manufacturing method, the manufacture of uncreped through-air dried (UCTAD) tissue, or alternative manufacturing methods, e.g. the Advanced Tissue Molding System (ATMOS) of the company Voith, or Energy Efficient Technologically Advanced Drying eTAD of the company Georgia Pacific, or Structured Tissue Technology SST of the company Metso Paper. Hybrid processes like NTT (New Textured Tissue of the company Metso Paper) which are alterations of the conventional processes can be used, too.

The conventional dry crepe manufacturing method includes the steps of:

- pressing and drying the wet paper fibers as a sheet on a large-diameter, heated cylinder (also called Yankee dryer); and
- subsequently detaching and creping the sheet of dried paper fibers by a metal blade applied against said cylinder, across its direction of rotation.

The creping operation creates undulations in the sheet across its direction of travel. The creping operation increases the thickness of the sheet, and confers elasticity and gives touch properties to the sheet.

The TAD manufacturing method includes the steps of:

- molding the sheet of wet paper fibers on a fabric; and
- subsequently drying the sheet, at least partly, by a current of hot air passing through it.

Subsequently, the dried sheet may be creped.

The web of absorbent substrate may also be a web of nonwoven fabric that is obtained by an air-laid manufacturing method or spun-laid manufacturing method or other manufacturing method. A nonwoven fabric including cellulosic fibers relates to an absorbent paper which is also called nonwoven or web made of fibers like air-laid web in this field of technology. A typical absorbent paper has a basis weight, in the range from 20 to 300 g/m$^2$, or 40 to 60 g/m$^2$.

Once, the web of absorbent substrate has been manufactured, a distinct manufacturing operation called converting operation is necessary to form the end product (i.e. the paper towel, toilet tissue rolls, bathroom tissue, wiping tissue, kitchen tissue rolls, handkerchiefs, etc . . . ). During the converting operation, several of such sheets, also called plies, can be combined to form said end product.

It is possible to combine several plies together to confer particular properties on a sheet such as thickness, softness, and bulkiness.

Several plies may be combined together by a combining operation of a chemical nature (e.g. by adhesive bonding), or of a mechanical nature (e.g. by knurling or embossing), or a combination of both. During adhesive bonding, a film of adhesive is deposited over some or all of the surface of one of the plies, then the adhesive-treated surface is placed in contact with the surface of at least one other ply. During the mechanical combination, the plies may be combined by knurling, or by compression, or by embossing. Embossing is a deformation in the thickness of the ply or of the multiple plies. It results in a ply having a particular relief or indentation. The thickness of the ply or of the multiple plies is increased after embossing compared with its initial thickness.

There is a need to improve the thickness, softness, bulkiness, absorption capacity and/or strength (i.e. properties) of the multi-ply tissue products. Further, this should be obtained by using less paper fibers resulting in economical and environmental positive aspects. For example, there is a need to obtain similar properties with less plies, for example a four plies product having properties equivalent to a five plies product.

SUMMARY

To address these and other problems with conventional designs, the present invention proposes a multi-ply tissue paper product having similar properties as prior art multi-ply tissue paper products while including less number of plies. Alternatively, the present invention proposes a multi-ply tissue paper product having better properties and/or performance than prior art five plies tissue paper product while having the same quantity of fibers.

According to one embodiment of the invention, there is provided a multi-ply tissue paper product including at least four plies made of tissue paper base-sheet or non-woven, wherein:

- two inner plies (a first inner ply and a second inner ply) are positioned between a first outer ply on one side and a second outer ply on another side;
- the two inner plies are flat plies;
- the first and second outer plies include a micro-embossing pattern; and
- only one of said outer plies further includes a décor embossing pattern.

In one embodiment, at least 51% of the surface of the two inner plies may be flat.

In another embodiment, at least 90% of the surface of the two inner plies may be flat.

In a further embodiment, around 0.2% to 20%, in particular 0.5% to 6% of a surface between the second inner ply and the second outer ply is being glued.

In yet another embodiment, an additional core ply may be positioned in-between the two inner plies.

In such embodiments, the additional core ply may include a micro-embossing pattern.

The first outer ply may be bonded to the first inner ply and the second inner ply through at least some tips of protuberances associated to the décor embossing pattern, and the second outer ply may be bonded to the second inner ply through at least some tips of protuberances associated to the second micro-embossing pattern.

In one embodiment, the micro-embossing patterns of the first outer ply and the second outer ply may include protuberances of substantially identical heights.

In another embodiment, the protuberances of the micro-embossing patterns may be chosen from corrugations, undulations, wave-like profiles, pyramid or cone based micro-embossments, truncated pyramid or truncated cone micro-embossments.

According to another embodiment of the invention, there is provided a method for manufacturing multi-ply tissue paper product including at least four plies made of tissue paper base-sheet or non-woven, two inner plies being positioned between a first outer ply on one side and a second outer ply on another side, wherein the manufacturing method includes:

- micro-embossing separately the first and second outer plies;
- embossing only one of said outer plies;
- laminating and ply bonding the first outer ply and the first inner ply together;
- separately laminating and ply bonding the second inner ply and the second outer ply together; and
- separately associating the laminated first outer ply and first inner ply with the laminated second inner ply and second outer ply together.

In one embodiment, the multi-ply tissue paper product may further include an additional core ply positioned in-between the two inner plies, said additional core ply being laminated and ply bonded together with, on one side, the first outer ply and the first inner ply and, on another side, the second inner ply and the second outer ply.

In a further embodiment, the additional core ply may be further micro-embossed prior to the laminating and ply bonding steps.

According to another embodiment, there is provided a converting machine/line for implementing the method for manufacturing a multi-ply tissue paper product including at least four plies made of tissue paper base-sheet or non-woven as described above including two separate lamination units.

According to still a further embodiment, there is provided a roll of sheet material including a multi-ply tissue paper product according to one embodiment of the invention wound onto a core.

According to yet another embodiment, there is provided a folded sheet material including a multi-ply tissue paper product according to one embodiment of the invention cut, stacked and folded into a package.

According to a further embodiment, there is provided a use of a multi-ply tissue paper product according to one embodiment of the invention as paper towel, toilet tissue rolls, bathroom tissue, wiping tissue, kitchen tissue rolls, facial tissue, handkerchiefs or napkins.

The multi-ply tissue paper product according to the various embodiments of the invention is bulky, thick and soft compared to equivalent multi-ply tissue paper product available on the market. It results in good tactile impression while having a lower grammage compared to conventional multi-ply tissue paper products showing similar bulkiness and softness but having more plies. Because of the less number of plies for similar properties, the embodiments of the invention further result in paper fiber savings. Thus, the multi-ply tissue paper product of embodiments of the invention is ecological, at least reduces the impact of the paper industry onto the environment and further enables minimizing the production cost. Further, the structure of multi-ply tissue paper product enables maintaining the thickness during winding operations.

Other advantages will become apparent from the hereinafter description of embodiments of the invention.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, explain the one or more embodiments of the invention.

DETAILED DESCRIPTION

Figure 1:
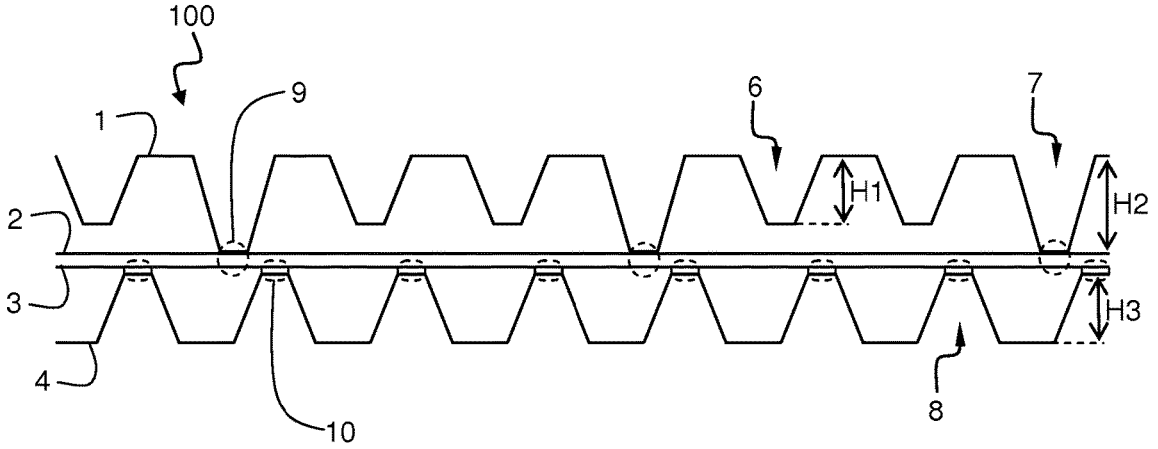
FIG. 1 is a side cross-section view of a multi-ply tissue paper product schematically illustrating a first embodiment of the invention including four plies, with the plies clearly separated from each other for illustration purposes.
Figure 1A:
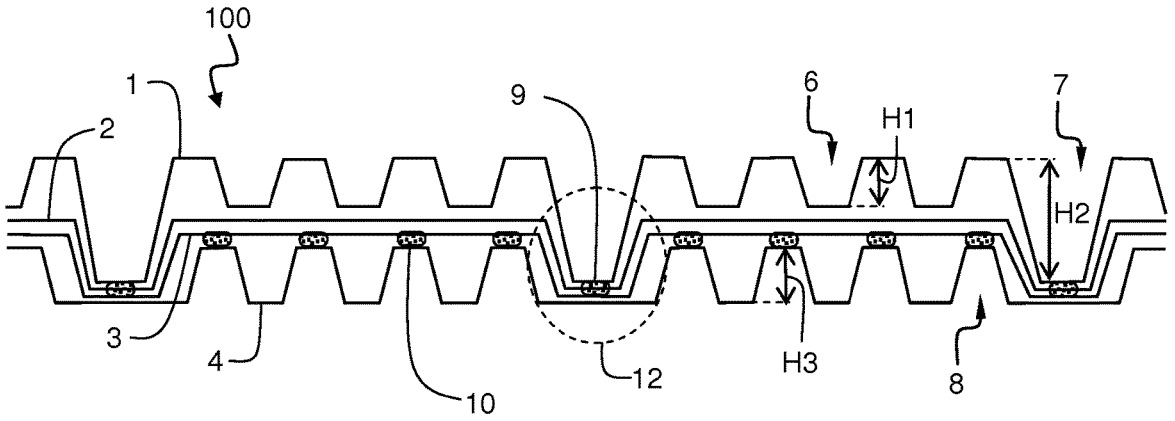
FIG. 1A is a side cross-section view of the multi-ply tissue paper product of FIG. 1, schematically illustrating the first embodiment after an embossing step of the lamination process for making the tissue paper product is conducted.
Figure 2:
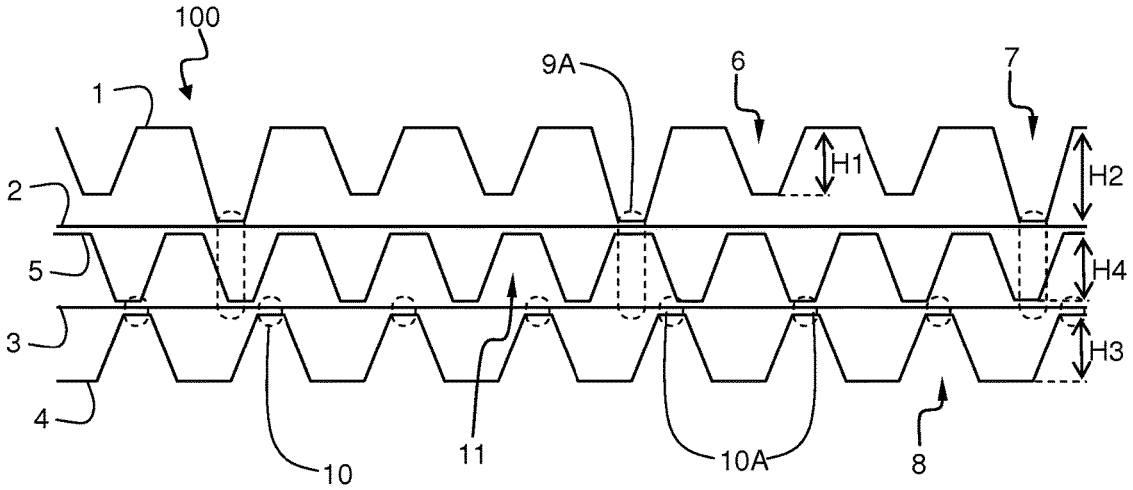
FIG. 2 is a side cross-section view of a multi-ply tissue paper product schematically illustrating a second embodiment of the invention including five plies, with the plies clearly separated from each other for illustration purposes.
Figure 2A:
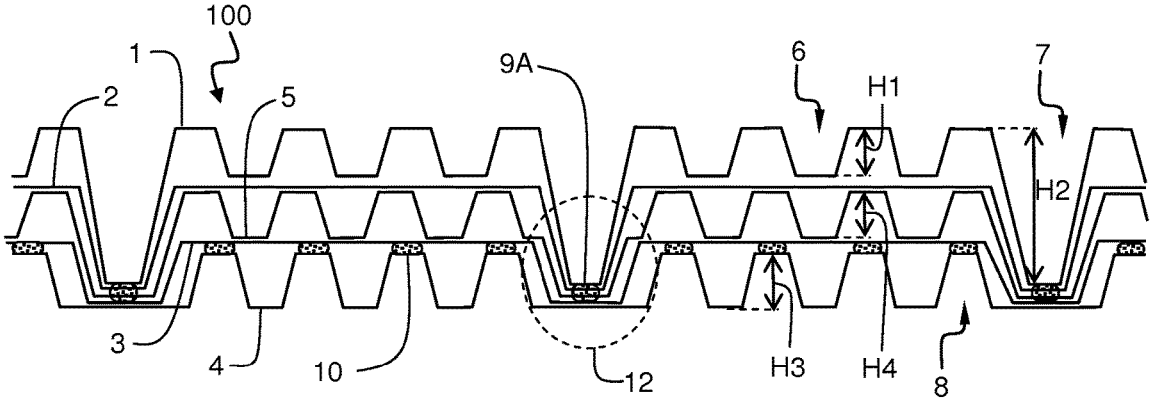
FIG. 2A is a side cross-section view of the multi-ply tissue paper product of FIG. 2, schematically illustrating the second embodiment after an embossing step of the lamination process for making the tissue paper product is conducted.

FIGS. 1, 1A, 2, and 2A are side cross-section views schematically illustrating the layer structure of the multi-ply tissue paper product according to a first embodiment and a second embodiment, respectively. FIGS. 1 and 2 schematically illustrate the layer structure of the multi-ply tissue paper product showing the plies that are clearly separated from each other for the sake of clarity. FIGS. 1A and 2A schematically illustrate the layer structure of the multi-ply tissue paper product showing the plies having been crushed by the embossing step of the lamination process, thus more close to reality of the multi-ply tissue paper product structure.

FIG. 1 schematically illustrates the first embodiment of the multi-ply tissue paper product 100 including four plies, namely a first outer ply 1, a first inner ply 2, a second inner ply 3 and a second outer ply 4. The first inner ply 2 and the second inner ply 3 are disposed in a central position between the first outer ply 1 and the second outer ply 4. Thus, the first outer ply 1 is on one side of the multi-ply tissue paper product 100, while the second outer ply 4 is on the other side of the multi-ply tissue paper product 100. Each of these plies can be made of tissue paper base-sheet produced either by "Conventional" manufacturing methods as in the manufacture of for example "Dry Crepe Tissue" or "Wet Crepe Tissue", or "Structured Tissue" manufacturing methods as for example the "Through Air Drying" (TAD) manufacturing method.

The first inner ply 2 includes front and back faces that are smooth and flat. The first inner ply 2 is unhandled or untreated (i.e. not micro-embossed, not embossed) during the converting process (i.e. in the dry state). This corresponds to a "conventional flat" definition. However, here, the terminology "flat" is also intended to include a "structured flat" definition, namely a structured surface of a structured ply resulting from the wet state of the papermaking manufacturing method (e.g. a structured ply has a structured surface resulting from the fabric used during the TAD manufacturing method). The second inner ply 3 is identical to the first inner ply 2. However, the two inner plies 2 and 3 undergo deformations resulting from the embossing step of the lamination process. Such deformations are localized in crushed zones 12 right behind the protuberances of the décor embossing pattern 7. Thus, the terminology "flat" means, in the context of the present application, that at least 51% of the surface of the two inner plies 2 and 3 may be flat, or at least 90% of the surface of the two inner plies 2 and 3 may be flat.

The first outer ply 1 is provided with a first micro-embossing pattern 6 with first protuberances of height H1. The first outer ply 1 is also provided with a décor embossing pattern 7 with second protuberances of height H2 (H2>H1). The density of the first protuberances (micro-embossing pattern 6) is greater than the density of the second protuberances (décor embossing pattern 7).

The second outer ply 4 is provided with a second micro-embossing pattern 8 with third protuberances of height H3. The height H3 of the third protuberances may be different to the height H2 of the second protuberances. Alternatively, the height H3 of the third protuberances may be similar to the height H2 of the second protuberances (H3=H2). In this alternative, the first micro-embossing pattern 6 is similar to the second micro-embossing pattern 8. The second outer ply 4 is not provided with any décor embossing pattern.

The first outer ply 1 is positioned and orientated with respect to the second outer ply 4 such that the protuberances of the respective micro-embossing patterns 6, 8 and décor embossing pattern 7 are mainly not in a nested configuration or in a pin to pin configuration.

The two inner flat plies 2 and 3 are bringing strength to the multi-ply tissue paper product 100. The first and second outer plies 1 and 4 are bringing thickness, absorption and softness to the multi-ply tissue paper product 100.

The four plies may be coupled together by an adhesive through two distinct ply-bonding operations that will be explained in relation with FIG. 8. In particular, the first outer ply 1 is bonded to the first inner ply 2 and the second inner ply 3 at the level of at least the tips 9 of the second protuberances (i.e. via the décor embossing pattern 7). The second outer ply 4 is bonded to the second inner ply 3 at the level of at least the tips 10 of the third protuberances (i.e. via the second micro-embossing pattern 8). Thus, a sufficient association and coherency of the multi-ply tissue paper product 100 is achieved.

Because the gluing areas are limited to the distal planar areas of the high protuberances of the embossed first outer ply 1, the resulting stiffness of the multi-ply tissue paper product 100 can be predefined. Thus, the resulting stiffness may be adjusted. FIG. 1 only illustrates a particular example including a rate of one high protuberance for two shallow micro-protuberances. One can understand that this rate is not limitative and that any other rate can be chosen in order to have a compromise between the bonding of the plies and the resulting stiffness, for example a rate of one high protuberance for five shallow micro-protuberances may also be appropriate.

FIG. 2 schematically illustrates a second embodiment of the multi-ply tissue paper product 100. The second embodiment differs from the first embodiment in that it further includes an additional core ply 5 in-between the two inner plies. The additional core ply 5 is provided with a third micro-embossing pattern 11 with fourth protuberances of height H4. The height H4 of the fourth protuberances may be different to the height H1 of the first protuberances, or the height H2 of the second protuberances or the height H3 of the third protuberances. Alternatively, the height H4 of the fourth protuberances may be similar to the height H1 of the first protuberances, or the height H2 of the second protuberances or the height H3 of the third protuberances (H4=H1 or H2 or H3). In the alternative depicted in FIG. 2, the fourth micro-embossing pattern 11 is similar to the first micro-embossing pattern 6 or to the second micro-embossing pattern 8.

The five plies may be coupled together by an adhesive through two distinct ply-bonding operations that will be explained in relation with FIG. 9. In particular, the first outer ply 1 is bonded to the first inner ply 2 at the level of at least the tips 9 of the second protuberances (i.e. via the décor embossing pattern 7) and the additional core ply 5 at the level of at least the overlapping tips 9A of the second protuberances (i.e. via the décor embossing pattern 7) and of the facing fourth protuberances (i.e. via fourth micro-embossing pattern 11). The second outer ply 4 is bonded to the second inner ply 3 at the level of at least the tips 10 of the third protuberances (i.e. via the second micro-embossing pattern 8) and the additional core ply 5 at the level of at least the overlapping tips 9A and of the facing fourth protuberances (i.e. via the fourth micro-embossing pattern 11). Thus, a sufficient association and coherency of the multi-ply tissue paper product 100 is achieved.

Figure 3:
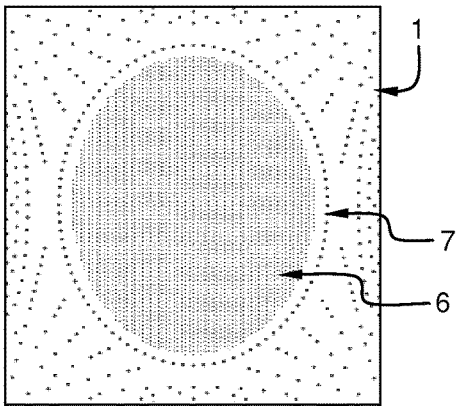
FIG. 3 is a plan view of the multi-ply tissue paper product according to embodiments of the invention, including the décor embossing pattern according to a first example.

FIG. 3 schematically illustrates a view of a side of the multi-ply tissue paper product 100 (i.e. the first outer ply 1) including the décor embossing pattern 7 according to a first example. The depicted area corresponds to one sheet of toilet paper (for example a rectangular shape of 10 cm×12 cm dimensions). In the first example, the second protuberances of height H2 of the décor embossing pattern 7 corresponds to a dotted ellipse in a central part of the sheet, a plurality of dotted lines extending from each corner towards the dotted ellipse according to different angles, and dotted curves along each edge of the sheet. The central part of the sheet within the area defined by the dotted ellipse is provided with the first micro-embossing pattern 6.

Figure 4:
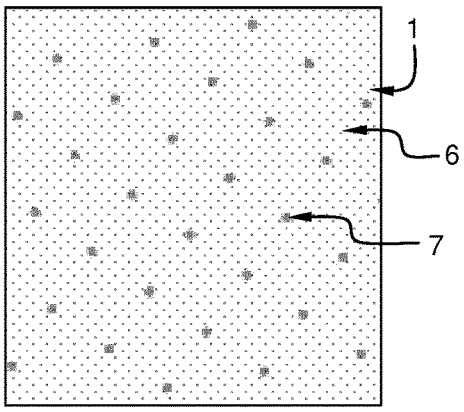
FIG. 4 is a plan view of the multi-ply tissue paper product according to embodiments of the invention, including the décor embossing pattern according to a second example.

FIG. 4 schematically illustrates a view of a side of the multi-ply tissue paper product 100 (i.e. the first outer ply 1) including the décor embossing pattern 7 according to a second example. The depicted area corresponds to one sheet of toilet paper (for example a rectangular shape of 10 cm×12 cm dimensions). In the first example, the second protuberances of height H2 of the décor embossing pattern 7 corresponds to dots distributed along parallel lines. The whole sheet is provided with the first micro-embossing pattern 6.

Figure 5:
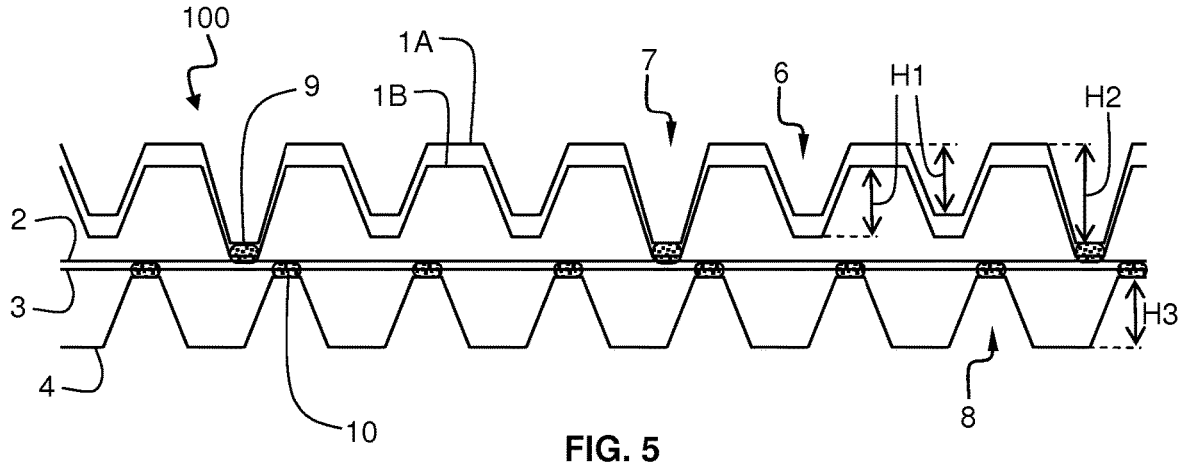
FIG. 5 is a side cross-section view of a multi-ply tissue paper product schematically illustrating a third embodiment of the invention including five plies.

FIG. 5 is a side cross-section view in a multi-ply tissue paper product 100 schematically illustrating a third embodiment including five plies. The number of the first outer ply 1 has been doubled relatively to the first embodiment of FIG. 1. Both first outer plies 1A and 1B are provided with a first micro-embossing pattern 6 with first protuberances of height H1, and also with a décor embossing pattern 7 with second protuberances of height H2 (H2>H1).

Figure 6:
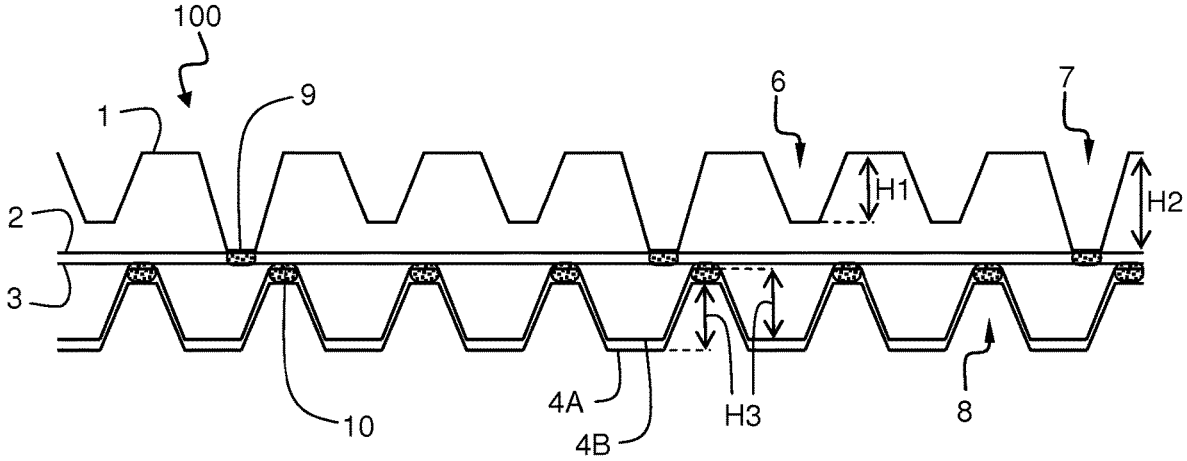
FIG. 6 is a side cross-section view of a multi-ply tissue paper product schematically illustrating a fourth embodiment of the invention including five plies.

FIG. 6 is a side cross-section view in a multi-ply tissue paper product 100 schematically illustrating a fourth embodiment including five plies. The number of the second outer ply 4 has been doubled relatively to the first embodiment of FIG. 1. Both second outer plies 4A and 4B are provided with a second micro-embossing pattern 8 with third protuberances of height H3.

Figure 7:
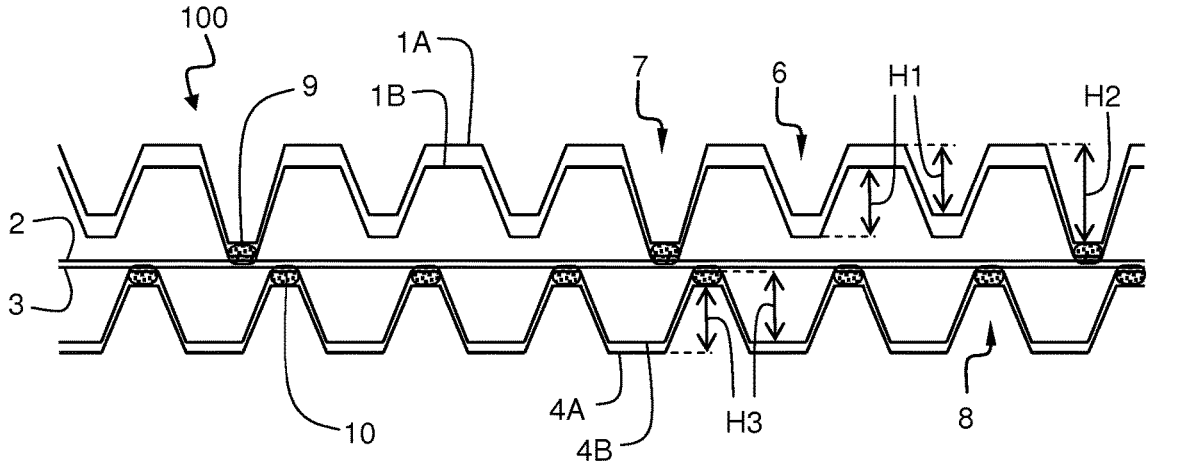
FIG. 7 is a side cross-section view of a multi-ply tissue paper product schematically illustrating a fifth embodiment including six plies.

FIG. 7 is a side cross-section view in a multi-ply tissue paper product 100 schematically illustrating a fifth embodiment including six plies. This embodiment is a combination of the third and fourth embodiment. The number of the first outer ply 1 has been doubled relatively to the first embodiment of FIG. 1. Both first outer plies 1A and 1B are provided with a first micro-embossing pattern 6 with first protuberances of height H1, and also with a décor embossing pattern 7 with second protuberances of height H2 (H2>H1). Further, the number of the second outer ply 4 has been doubled relatively to the first embodiment of FIG. 1. Both second outer plies 4A and 4B are provided with a second micro-embossing pattern 8 with third protuberances of height H3.

As further alternatives (not shown), the embodiments depicted in FIGS. 5, 6 and 7 may also include an additional core ply 5 in-between the two inner plies 2 and 3.

Figure 8:
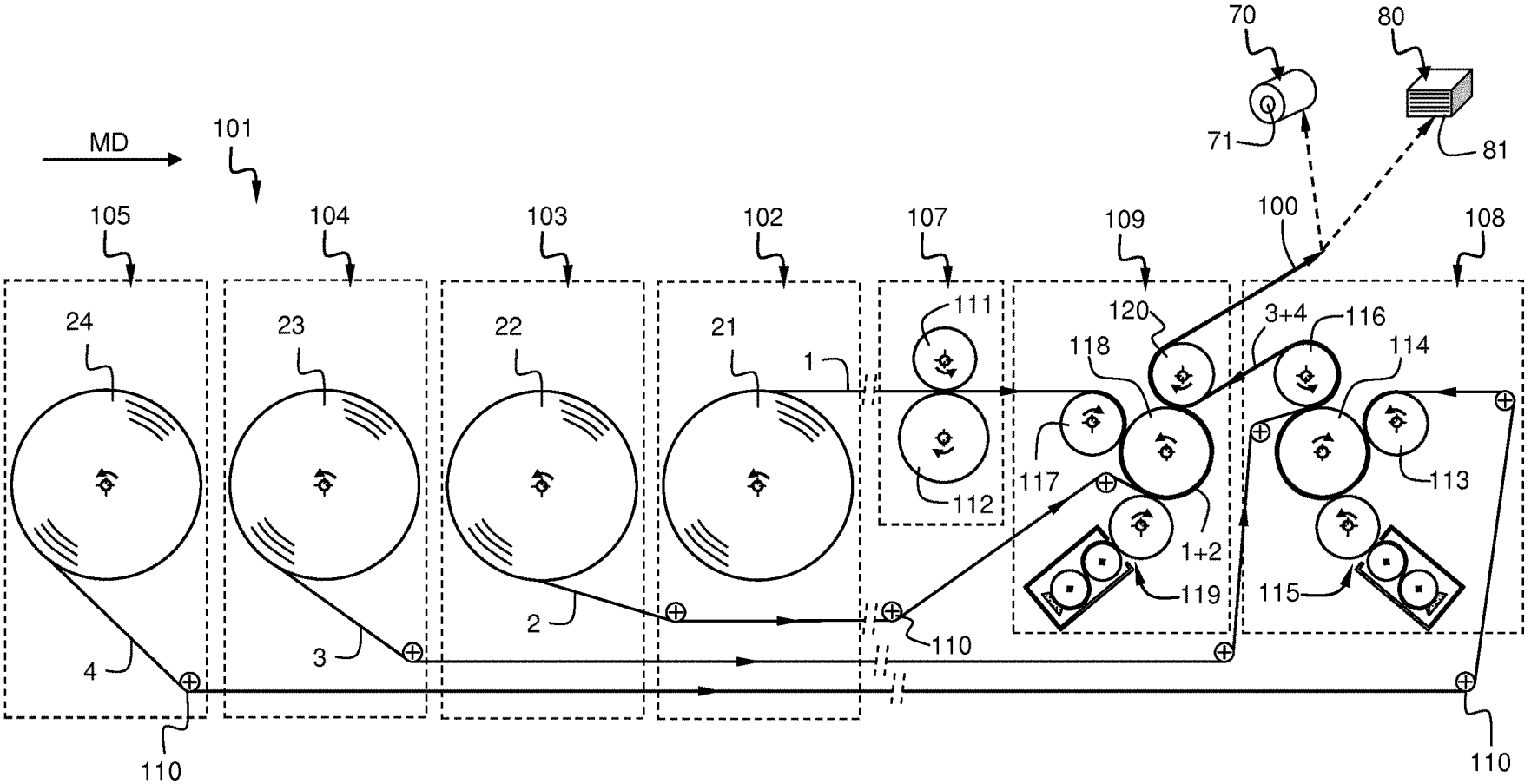
FIG. 8 is a schematic side view of a converting assembly and method for manufacturing multi-ply tissue paper product according to one embodiment of the invention.

FIG. 8 schematically and partially illustrates an example of a converting assembly and method for manufacturing the multi-ply tissue paper product according to the first embodiment.

In this example, the converting machine/line 101 includes four unwinding units 102, 103, 104 and 105, a pre micro-embossing unit 107, a first lamination unit 108 and a second lamination unit 109.

At the stage of FIG. 8, absorbent log base webs have already been produced according to a known papermaking process. FIG. 8 illustrates a later stage which is a stage where a converting process takes place. The converting process converts large parent log base webs (e.g. having a strip width from around 1.80 m to around 7 m) into retail sized rolls (not shown), e.g. bathroom tissue rolls, paper towels rolls (e.g. having a strip width from around 8 cm to around 40 cm). In this example, the converting machine/line 101 produces multi-ply tissue paper product having four plies.

A first unwinding unit 102 provides a first absorbent log base web that will form the first outer ply 1 from a first parent roll 21. A second unwinding unit 103 provides a second absorbent log base web that will form the first inner ply 2 from a second parent roll 22. A third unwinding unit 104 provides a third absorbent log base web that will form the second inner ply 3 from a third parent roll 23. A fourth unwinding unit 105 provides a fourth absorbent log base web that will form the second outer ply 4 from a fourth parent roll 24.

Various rollers 110 are appropriately positioned in order to control the path of the absorbent log base webs along the converting machine/line 101, within and between the various units 102, 103, 104, 105, 107, 108 and 109. The absorbent log base webs travel into the converting machine/line 101 according to the machine direction MD from the unwinding units 102, 103, 104 and 105, towards the pre micro-embossing unit 107, and towards the first 108 and second 109 lamination units.

The absorbent log base web that will form the first outer ply 1 is fed to the pre micro-embossing unit 107. The pre micro-embossing unit 107 includes a first engraved cylinder 111, a first anvil cylinder 112, both rotating in opposite directions. The first outer ply 1 is provided with the first micro-embossing pattern 6 with first protuberances of height H1. Then the first outer ply 1 is fed to the second 109 lamination unit. The first anvil cylinder 112 can be a mating rubber cylinder, or a mating steel cylinder.

The first lamination unit 108 includes a second engraved cylinder 114, a second anvil cylinder 113, a first glue dispenser 115, and a first association cylinder 116. The second engraved cylinder 114 is associated with the second anvil cylinder 113, both rotating in opposite directions. The first glue dispenser 115 includes a first applicator cylinder that is associated with the second engraved cylinder 114, both rotating in opposite directions. The association cylinder 116 is associated with the second engraved cylinder 114, both rotating in opposite directions. The second anvil cylinder 113, the first applicator cylinder of the first glue dispenser 115 and the first association cylinder 116 are disposed around the circumference of the second engraved cylinder 114 according to the clockwise direction. The second anvil cylinder 113 can be a mating rubber cylinder, or a mating steel cylinder.

The second lamination unit 109 includes a third engraved cylinder 118, a third anvil cylinder 117, a second glue dispenser 119, and a second association cylinder 120. The third engraved cylinder 118 is associated with the third anvil cylinder 117, both rotating in opposite directions. The second glue dispenser 119 includes a second applicator cylinder that is associated with the third engraved cylinder 118, both rotating in opposite directions. The second association cylinder 120 is associated with the third engraved cylinder 118, both rotating in opposite directions. The third anvil cylinder 117, the second applicator cylinder of the second glue dispenser 119 and the association cylinder 120 are disposed around the circumference of the third engraved cylinder 118 according to the anti-clockwise direction. The third anvil cylinder 117 can be a mating rubber cylinder, or a mating steel cylinder.

The operations of the first lamination unit 108 and the second lamination unit 109 are as follows.

The second inner ply 3 and the second outer ply 4 are fed to the first lamination unit 108, while the first outer ply 1 and the first inner ply 2 are fed to the second lamination unit 109.

In the first lamination unit 108, the second outer ply 4 is provided with the second micro-embossing pattern 8 (third protuberances of height H3) by passing in the nip between the second engraved cylinder 114 and the second anvil cylinder 113. Then, the tips 10 of the third protuberances of the micro-embossing pattern 8 are glued by the first glue dispenser 115. The glue dispenser 115 typically includes a vat, an applicator cylinder and a dipping cylinder. The applicator cylinder abuts the second outer ply 4 against the second engraved cylinder 114. The dipping cylinder picks up the adhesive in the vat and transfers the adhesive to the applicator cylinder. The applicator cylinder is arranged to exercise a determined pressure on the second engraved cylinder 114 at the distal area of protuberances of the micro-embossed second outer ply 4 (at the level of at least the tips 10). At said determined pressure, the adhesive crosses through the second outer ply 4. Subsequently, the second inner ply 3 and the second outer ply 4 are superposed and combined by passing in the nip between the association cylinder 116 and the second engraved 114 in order to bond the second inner ply 3 and the second outer ply 4 together. The resulting web 3+4 is then fed to the second lamination unit 109.

In the second lamination unit 109, the already micro-embossed first outer ply 1 is provided with a décor embossing pattern 7 with second protuberances of height H2 by passing in the nip between the third engraved cylinder 118 and the third anvil cylinder 117. Both, the first outer ply 1 and the first inner ply 2 are then superposed and combined by passing in the nip between the applicator cylinder of the second glue dispenser 119 and the third engraved cylinder 118. The glue dispenser 119 typically includes a vat, an applicator cylinder and a dipping cylinder. The applicator cylinder abuts first outer ply 1 and the first inner ply 2 together against the third engraved cylinder 118. The dipping cylinder picks up the adhesive in the vat and transfers the adhesive to the applicator cylinder. The applicator cylinder is arranged to exercise a determined pressure on the third engraved cylinder 118. At said determined pressure, the adhesive crosses through the first outer ply 1 and the first inner ply 2 towards the distal area of protuberances of the embossed first outer ply 1 (at the level of at least the tips 9). Thus, the first outer ply 1 and the first inner ply 2 are bonded together. The resulting webs 1+2 and 3+4 are then fed in the nip between the second association cylinder 120 and the third engraved cylinder 118. The resulting webs 1+2 and 3+4 are superposed and combined by passing in the nip between these cylinders 118 and 120 that still enables the adhesive to cross through the second inner ply 3 and to bond the resulting web 1+2 to the resulting web 3+4. As a result, the multi-ply tissue paper product 100 is produced.

The pre micro-embossing unit 107 and, thus, the corresponding pre-embossing step are optional. As an alternative to the pre-embossing feature depicted in FIG. 8, the micro-embossing and embossing steps can be done in a single step by the second lamination unit 109 equipped with a third engraved cylinder 118 being a double height embossing and micro-embossing cylinder.

Then, the multi-ply tissue paper product may be wound onto a core 71 as a roll of sheet material 70, or may be stacked and folded into a package 81 as a folded sheet material 80.

Briefly, as it is known in the art, the converting machine/line 101 may further include, after the second lamination unit 109, a rewinding unit that includes a perforating module, a cutting module, a winding module. The rewinding unit winds the web of multi-ply tissue paper product 100 into multiple logs. The perforating module is arranged to provide the web of multi-ply tissue paper product 100 with regularly spaced perforation lines substantially transversally orientated relatively to the machine direction MD (i.e. the perforation lines are substantially orientated according to the cross-machine direction). The cutting module is arranged to sever the web of multi-ply tissue paper product 100 substantially transversally relatively to the machine direction (i.e. the separation line is substantially orientated according to the cross-machine direction). The severing of web occurs at a transition phase, namely when a first log is finished at the end of a log production cycle, and before a second subsequent log starts to be wound at the beginning of a new log production cycle. The winding module is arranged to wind the web of multi-ply tissue paper product 100 so as to produce logs of web of multi-ply tissue paper product. For example, the winding module is of the peripheral or the surface type. The log is formed by winding the web of multi-ply tissue paper product 100 onto a core 71. The produced log is then cut by multiple log saws into multiple and individual rolls 70 of multi-ply tissue paper product 100.

Alternatively and briefly, as it is known in the art, the converting machine/line 101 may further include, after the second lamination unit 109, a folding unit that cut, stack, fold individual sheets (towels, handkerchiefs, etc . . . ) and gather into packages 81 individual sheets 80 of multi-ply tissue paper product 100.

Then, the resulting multi-ply tissue paper product may be used as paper towel, toilet tissue rolls, bathroom tissue, wiping tissue, kitchen tissue rolls, facial tissue or handkerchiefs, etc . . . .

Figure 9:
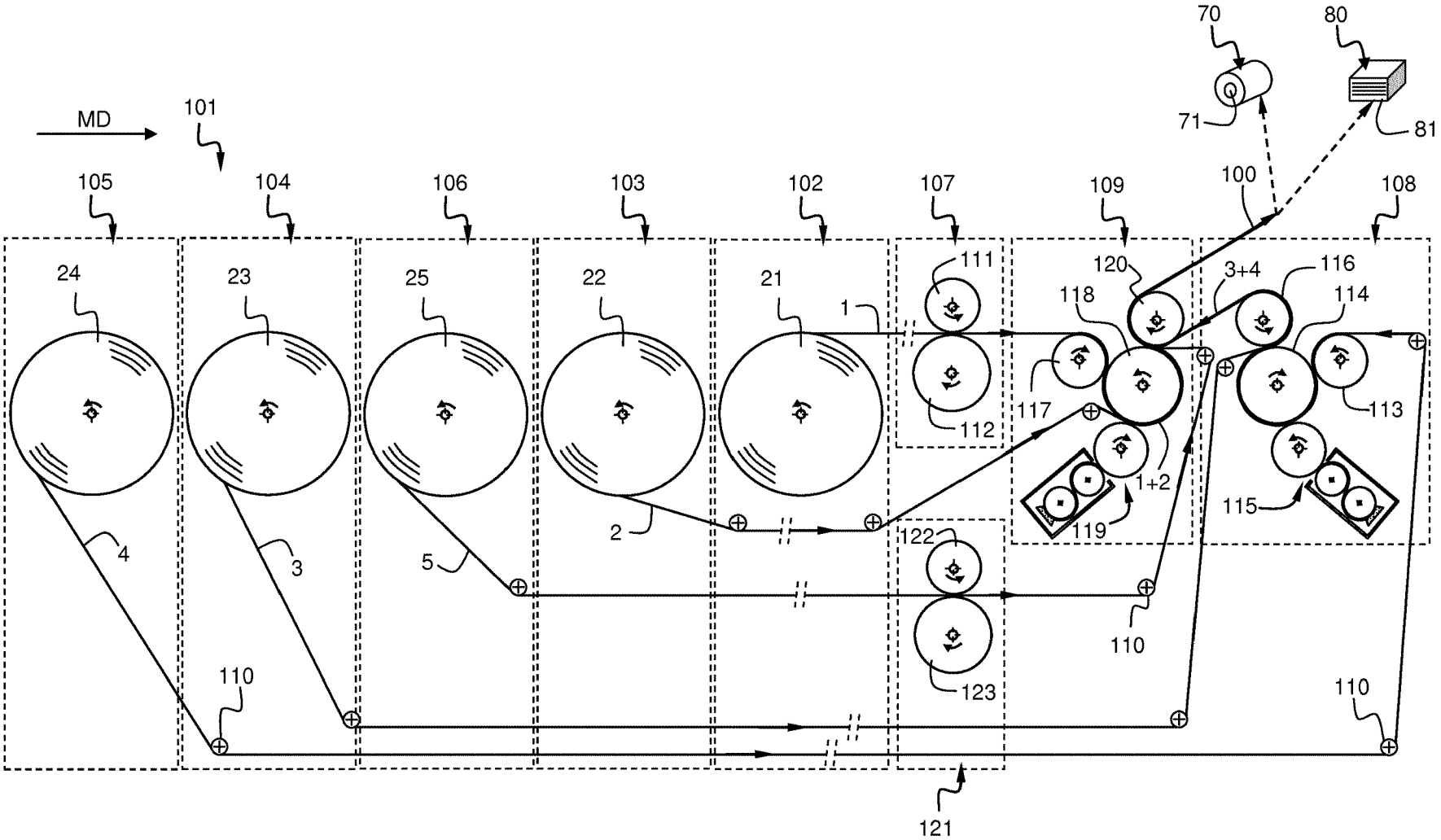
FIG. 9 is a schematic side view of a converting assembly and method for manufacturing multi-ply tissue paper product according to another embodiment of the invention.

FIG. 9 schematically and partially illustrates another example of a converting assembly and method for manufacturing the multi-ply tissue paper product according to the second embodiment. The converting machine/line 101 for manufacturing the multi-ply tissue paper product 100 according to the second embodiment differs from the one depicted in FIG. 8 in that it further includes a fifth unwinding unit 106 and a second pre micro-embossing unit 121.

The fifth unwinding unit 106 provides a fifth absorbent log base web that will form the additional core ply 5 from a fifth parent roll 25.

The absorbent log base web that will form the additional core ply 5 is fed to the second pre micro-embossing unit 121. This pre micro-embossing unit 121 includes a first engraved cylinder 122, a first anvil cylinder 123, both rotating in opposite directions. The additional core ply 5 is provided with the third micro-embossing pattern 11 with fourth protuberances of height H4. Then the additional core ply 5 is fed to the second lamination unit 109. Thus, the additional core ply 5 is inserted between the resulting web 1+2 including the first outer ply 1 and the first inner ply 2, and the resulting web 3+4 including the second inner ply 3 and the second outer ply 4. All these are superposed and combined by passing between the second association cylinder 120 and the third engraved cylinder 118 in order to bond the additional core ply 5, to the first outer ply 1 and the first inner ply 2 on one side and to the second inner ply 3 and the second outer ply 4 on the other side, together. The second outer ply 4 is bonded to the second inner ply 3 at the level of at least the tips 10 of the third protuberances (i.e. via the second micro-embossing pattern 8) and the additional core ply 5 at the level of at least the overlapping tips 10A of the third protuberances (i.e. via the second micro-embossing pattern 8) and of the facing fourth protuberances (i.e. via the fourth micro-embossing pattern 11). All the plies 1, 2, 3, 4 and 5 are bonded together at the crushed zones 12 resulting from the décor pattern embossing.

The converting assembly for manufacturing the multi-ply tissue paper product according to the first or second embodiment includes two lamination units that ease processability (i.e. the settings of the converting machine/line are easier to define), facilitate implementation when the converting machine/line operates at industrial speed (i.e. the converting machine/line is easier to control) and enable better bonding of the plies resulting in a qualitative multi-ply tissue paper product.

The method for manufacturing the multi-ply tissue paper product according to the first or second embodiment enables saving some glue required to bond the plies as less adhesive is necessary. As a further result, the multi-ply tissue paper product is less stiff. Further, as an alternative, the second inner ply 3 and the second outer ply 4 may be bonded together by knurling.

In the preceding embodiments, the microstructure pattern may include corrugations, undulations, wave-like profiles, pyramid or cone based micro-embossments, truncated pyramid or truncated cone micro-embossments.

As an example, the height H2 (décor embossing pattern) ranges between 0.2 mm and 1 mm, between 0.4 mm and 0.8 mm or between 0.4 mm and 0.7 mm. This corresponds to embossing tips (engraving) on the cylinder having an engraving height ranging between 0.2 mm and 2.2 mm, between 0.5 mm and 2.0 mm or between 1 mm and 2 mm. The height H1 (micro-embossing pattern) ranges between 0.1 mm and 0.6 mm. The micro-embossing tips (engraving) on the cylinder have an engraving height ranging between 0.1 mm and 1 mm. The dots density for the décor embossing patterns may have a density inferior to 5 dots/cm$^2$, in particular inferior to 2 dots/cm$^2$. The dots density for the microstructure patterns may have a density larger than 30 dots/cm$^2$, in particular larger than 40 dots/cm$^2$. Further, around 0.2% to 20%, more preferably 0.5% to 6% of a surface between the second inner ply 3 and the second outer ply 4 is being glued.

The adhesive may be a polyvinyl acetate glue, water or a hot-melt glue. The adhesive may be diluted in water according to a proportion enabling an appropriate transfer to the various plies.

As an alternative to the glue dispensers 115 and 119, the adhesive (e.g. a hot melt glue, water, an aqueous glue, etc . . . ) may be sprayed by an appropriate dispensing system on each of the sides of the corresponding plies 2 and 4 before the joining with the other plies occurs.

The following Table 1 presents the various characteristics and properties that have been measured for comparing a multi-ply tissue paper product of the prior art which is a reference among the five plies tissue paper product (commercially available under Just-One®, a trademark of SCA) compared to the four plies tissue paper product according to the first embodiment and the five plies tissue paper product according to the second embodiment. Among those characteristics, the softness is a value obtained from a panel of consumers. The grammage is measured according to the standard EN ISO 12625-6:2005. The thickness is measured according to the standard EN ISO 12625-3:2005. The MD strength and CD strength (dry strength or dry tensile) are measured according to the standard EN ISO 12625-4:2005. The bulk index is a ratio equal to the thickness divided by the grammage. Thus, the bulk index represents an index of performance. In the first column, the first line relates to a five plies tissue paper product constituting a reference in term of thickness, softness and bulk. In the first column, the second line relates to the first embodiment depicted in FIG. 1. In the first column, the third line relates to the second embodiment depicted in FIG. 2.

TABLE 1

Measurements of Various Parameters of Tissue Paper Products

| | Plies Number | Grammage (g/m$^2$) | Thickness (mm) | MD strength (N/m) | CD strength (N/m) | Softness (Panel) | Bulk Index (cm$^3$/g) |
|---|---|---|---|---|---|---|---|
| Prior Art 5 plies | 5 | 93 | 0.79 | 477 | 233 | 1.7 | 8.5 |
| Embodiment of FIG. 1 | 4 | 76 | 0.86 | 425 | 230 | 1.7 | 11.3 |
| Embodiment of FIG. 2 | 5 | 93 | 1.01 | 608 | 302 | 1.7 | 10.9 |

Units: grammage in g/m$^2$, thickness in mm/sheet, machine direction MD strength in N/m, cross machine direction CD strength in N/m, softness without unit (comparison obtained from a panel of users), and bulk index in cm$^3$/g.

The characteristics and properties of the four plies tissue paper product according to the first embodiment are close or better than the five plies reference product while having a grammage 10% lower, a thickness 9% and a bulk index 33% higher. This means that a better, at least equivalent product with respect to thickness, softness, strength and clearly better bulk index is obtained while using less paper fiber than the reference product. Thus, by using less paper fiber, the multi-ply tissue paper products of embodiments of the invention result in an ecological and cost effective product. The additional inner core in the five plies tissue paper product according to the second embodiment brings a higher thickness and a higher CD strength to the multi-ply tissue paper product compared to the reference five plies product.

The drawings and their descriptions hereinbefore illustrate rather than limit the invention.

It is to be noted that separating the pre-embossing step from the embossing step, does not mean that it is not possible to combine pre-embossing step and embossing step in a single step. Thus, though the converting line has been described as including a pre-embossing unit, the pre-embossing unit 107 may be combined with the third engraved cylinder 117. The third engraved cylinder 117 may be engraved with a microstructure pattern and a structure pattern combining various micro-embossing tips and embossing tips (not shown). The third engraved cylinder 117 may then perform a double-level engraving into the first outer ply 1.

The numbers, densities, positions and shapes of the decorative patterns/embossments and the micro-embossments in the depicted embodiments are non-limitative examples. The skilled person will readily recognize that these numbers, densities, positions and shapes may be changed if desired or deemed necessary with respect to for example the desired aesthetic effect to be achieved by the multi-ply tissue paper products. The number of outer plies may be doubled, for example on the top or/and the bottom of the product resulting into a five or a six plies product.

Any reference sign in a claim should not be construed as limiting the claim. The word "comprising" does not exclude the presence of other elements than those listed in a claim. The word "a" or "an" or "at least one" preceding an element does not exclude the presence of a plurality of such element.

To this end, the embodiments described above are only descriptions of preferred embodiments of the present invention, and are not intended to limit the scope of the present invention. Various variations and modifications can be made to the technical solution of the present invention by those of ordinary skills in the art, without departing from the design and spirit of the present invention. The variations and modifications should all fall within the claim scope defined by the claims of the present invention.

What is claimed is:

1. A multi-ply tissue paper product comprising at least four plies made of tissue paper base-sheet or non-woven, wherein:

two inner plies are positioned between a first outer ply on one side and a second outer ply on another side;

the two inner plies are flat plies;

the first and second outer plies each comprise a micro-embossing pattern; and only the first outer ply further comprises a décor embossing pattern, wherein the décor embossing pattern is defined by protuberances that are larger in height than protuberances defining the micro-embossing pattern on the first outer ply, and the décor embossing pattern is applied to the first outer ply as all of the at least four plies are bonded together, thereby resulting in deformations being formed in all other plies in the at least four plies, specifically along crushed zones defined behind the protuberances of the décor embossing pattern, with all of the at least four plies thus bonded together at the crushed zones.

2. The multi-ply tissue paper product of claim 1, wherein at least 51% of a surface of the two inner plies is flat.

3. The multi-ply tissue paper product of claim 2, wherein at least 90% of the surface of the two inner plies is flat.

4. The multi-ply tissue paper product of claim 1, wherein the two inner plies include a first inner ply adjacent the first outer ply and a second inner ply adjacent the second outer ply, and wherein around 0.2% to 20% of a surface between the second inner ply and the second outer ply is being glued.

5. The multi-ply tissue paper product of claim 4, wherein around 0.5% to 6% of the surface between the second inner ply and the second outer ply is being glued.

6. The multi-ply tissue paper product of claim 1, further comprising an additional ply positioned between the two inner plies.

7. The multi-ply tissue paper product of claim 6, wherein the additional ply comprises another micro-embossing pattern.

8. The multi-ply tissue paper product of claim 7, wherein protuberances of the micro-embossing pattern of the additional ply are chosen from a group consisting of corrugations, undulations, wave-like profiles, pyramid or cone based micro-embossments, and truncated pyramid or truncated cone micro-embossments.

9. The multi-ply tissue paper product of claim 1, wherein the two inner plies include a first inner ply adjacent the first outer ply and a second inner ply adjacent the second outer ply, and wherein the first outer ply is bonded to the first inner ply and the second inner ply through at least some tips of the protuberances associated with the décor embossing pattern, and wherein the second outer ply is bonded to the second inner ply through at least some tips of protuberances associated with the micro-embossing pattern of the second outer ply.

10. The multi-ply tissue paper product of claim 1, wherein another ply having a micro-embossing pattern is positioned between at least one of the first outer ply and the second outer ply and the two inner plies.

11. The multi-ply tissue paper product of claim 1, wherein the micro-embossing patterns of the first outer ply and the second outer ply include protuberances of identical heights.

12. The multi-ply tissue paper product of claim 11, wherein the protuberances of the micro-embossing patterns of the first and second outer plies are chosen from a group consisting of corrugations, undulations, wave-like profiles, pyramid or cone based micro-embossments, and truncated pyramid or truncated cone micro-embossments.

13. A roll of sheet material comprising the multi-ply tissue paper product of claim 1, wound onto a core.

14. A folded sheet material comprising the multi-ply tissue paper product of claim 1, cut, stacked and folded into a package.

15. The multi-ply tissue paper product of claim 1, wherein at least 90% of the surface of the two inner plies is flat;

wherein the two inner plies include a first inner ply adjacent the first outer ply and a second inner ply adjacent the second outer ply, and wherein around 0.2% to 20% of a surface between the second inner ply and the second outer ply is being glued;

further comprising an additional ply positioned in-between the two inner plies, wherein the additional ply comprises another micro-embossing pattern;

wherein the first outer ply is bonded to the first inner ply and the second inner ply through at least some tips of the protuberances associated with the décor embossing pattern, and wherein the second outer ply is bonded to the second inner ply through at least some tips of protuberances associated with the micro-embossing pattern of the second outer ply;

wherein another ply having a micro-embossing pattern is positioned between at least one of the first outer ply and the second outer ply and the two inner plies;

wherein the micro-embossing patterns of the first outer ply and the second outer ply include protuberances of identical heights; and wherein the protuberances of the micro-embossing patterns of the first and second outer plies and of the additional ply are chosen from a group consisting of corrugations, undulations, wave-like profiles, pyramid or cone based micro-embossments, and truncated pyramid or truncated cone micro-embossments.

16. A method of manufacturing a multi-ply tissue paper product including at least four plies made of tissue paper base-sheet or non-woven, with first and second inner plies being positioned between a first outer ply on one side and a second outer ply on another side, wherein the method of manufacturing comprises:

micro-embossing separately the first and second outer plies to form micro-embossing patterns on the first and second outer plies;

embossing only one of the first and second outer plies to form a décor embossing pattern, wherein the décor embossing pattern is formed so as to be defined by protuberances that are larger in height than protuberances defining the micro-embossing pattern on the first outer ply;

laminating and ply bonding the first outer ply and the first inner ply together;

separately laminating and ply bonding the second inner ply and the second outer ply together; and separately associating the first outer ply and the first inner ply with the second inner ply and the second outer ply together to bond the at least four plies together, wherein the décor embossing pattern is applied to the first outer ply as all of the at least four plies are bonded together, thereby resulting in deformations being formed in all other plies in the at least four plies, specifically along crushed zones defined behind the protuberances of the décor embossing pattern, with all of the at least four plies thus bonded together at the crushed zones.

17. The method of claim 16, wherein the multi-ply tissue paper product further includes an additional ply positioned between the first and second inner plies, wherein the method further comprises:

laminating and ply bonding the additional ply together with, on one side, the first outer ply and the first inner ply and, on another side, the second inner ply and the second outer ply.

18. The method of claim 17, wherein the additional ply is further micro-embossed to form an additional micro-embossing pattern prior to the laminating and ply bonding steps.

* * * * *